US011733621B2

(12) United States Patent
Yoshioka et al.

(10) Patent No.: US 11,733,621 B2
(45) Date of Patent: Aug. 22, 2023

(54) IMAGE FORMING APPARATUS INCLUDING A TRANSFER CYLIDER, A SPROCKET, A CHAIN, AN IMAGE FORMING PART AND A TRANSFER UNIT

(71) Applicant: FUJIFILM Business Innovation Corp., Tokyo (JP)

(72) Inventors: Tomoaki Yoshioka, Kanagawa (JP); Mitsuaki Kuroda, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/665,046

(22) Filed: Feb. 4, 2022

(65) Prior Publication Data

US 2023/0062369 A1 Mar. 2, 2023

(30) Foreign Application Priority Data

Aug. 25, 2021 (JP) ..... 2021-137596

(51) Int. Cl.
*G03G 15/16* (2006.01)

(52) U.S. Cl.
CPC ..... *G03G 15/1605* (2013.01)

(58) Field of Classification Search
CPC ..... G03G 15/165
See application file for complete search history.

(56) References Cited

U.S. PATENT DOCUMENTS

2022/0107595 A1* 4/2022 Tanaka ..... B65H 29/044
2022/0184975 A1* 6/2022 Tanaka ..... G03G 15/6529

FOREIGN PATENT DOCUMENTS

JP 2002-108045 A 4/2002
JP 2012-220812 A 11/2012
JP 2017181763 A * 10/2017 ..... G03G 15/1605
WO 2020/174715 A1 9/2020
WO 2021/029119 A1 2/2021
WO 2021/054292 A1 3/2021

OTHER PUBLICATIONS

Extended European Search Report dated Aug. 12, 2022 in European Application No. 22166235.6.

* cited by examiner

*Primary Examiner* — Arlene Heredia
(74) *Attorney, Agent, or Firm* — Sughrue Mion, PLLC

(57) ABSTRACT

An image forming apparatus includes: a transfer cylinder that rotates; a rotating member that is coaxial with the transfer cylinder and rotates integrally with the transfer cylinder; a circulating member that is provided with a holding part that holds a front end portion of a recording medium, is suspended around the rotating member, and transports the recording medium by circulating as the rotating member rotates; an image forming part that forms an image; and a transfer unit having a transfer belt onto which the image is transferred from the image forming part at a contact position with the image forming part and that transfers the image onto the recording medium transported by the circulating member by sandwiching the recording medium together with the transfer cylinder at a nip position. A product of mass of the transfer cylinder and a distance from a center of mass of the transfer unit to the nip position is smaller than a product of mass of the image forming part and a distance from the center of mass to the contact position.

20 Claims, 4 Drawing Sheets

FIG. 4

| | EXAMPLE 1 | | | EXAMPLE 2 | | | COMPARATIVE EXAMPLE 1 | | |
|---|---|---|---|---|---|---|---|---|---|
| | MASS [kg] | DISTANCE [m] | PRODUCT | MASS [kg] | DISTANCE [m] | PRODUCT | MASS [kg] | DISTANCE [m] | PRODUCT |
| TRANSFER CYLINDER 50 | 52 | 0.490 | 25.5 | 152 | 0.490 | 74.5 | 240 | 0.490 | 117.6 |
| TONER IMAGE FORMING UNIT 222A | 125 | 0.250 | 31.3 | 125 | 0.250 | 31.3 | 125 | 0.250 | 31.3 |
| TONER IMAGE FORMING UNIT 222B | 125 | 0.379 | 47.4 | 125 | 0.379 | 47.4 | 125 | 0.379 | 47.4 |
| TONER IMAGE FORMING UNIT 222C | 125 | 0.780 | 97.5 | 125 | 0.780 | 97.5 | 125 | 0.780 | 97.5 |
| TONER IMAGE FORMING UNIT 222D | 128 | 0.841 | 107.6 | 128 | 0.841 | 107.6 | 128 | 0.841 | 107.6 |
| TONER IMAGE FORMING UNIT 222E | 128 | 0.575 | 73.6 | 128 | 0.575 | 73.6 | 128 | 0.575 | 73.6 |
| TONER IMAGE FORMING UNIT 222F | 128 | 0.409 | 52.4 | 128 | 0.409 | 52.4 | 128 | 0.409 | 52.4 |
| OCCURRENCE OF BANDING | A | | | B | | | C | | |

IMAGE FORMING APPARATUS INCLUDING A TRANSFER CYLIDER, A SPROCKET, A CHAIN, AN IMAGE FORMING PART AND A TRANSFER UNIT

CROSS-REFERENCE TO RELATED APPLICATIONS

This application is based on and claims priority under 35 USC 119 from Japanese Patent Application No. 2021-137596 filed Aug. 25, 2021.

BACKGROUND

(i) Technical Field

The present disclosure relates to an image forming apparatus.

(ii) Related Art

Japanese Unexamined Patent Application Publication No. 2012-220812 discloses a transfer device including a belt-shaped image carrier that carries an image, a drive roller around which the image carrier carrying the image is suspended and that moves the image carrier, a first tension roller around which the image carrier moved by the drive roller is suspended and gives tension to the image carrier, a first elastic support part that has a first elastic member generating the tension and supports one end of a rotary shaft of the first tension roller, a second elastic support part that has a second elastic member generating the tension and supports the other end of the rotary shaft of the first tension roller, a backup roller around which the image carrier suspended around the tension roller is suspended, a transfer roller that has a recessed part on a circumferential surface and forms a transfer nip by making contact with the image carrier suspended around the backup roller, and a second tension roller around which the image carrier suspended around the backup roller is suspended and that gives tension to the image carrier.

Japanese Unexamined Patent Application Publication No. 2002-108045 discloses an image forming apparatus including plural toner image formation units each including a toner image carrier and forming a toner image of a corresponding color on the toner image carrier, and an intermediate transfer belt onto which toner images of respective colors formed on the respective toner image carriers are transferred, wherein the toner images of the respective colors transferred onto the intermediate transfer belt are further transferred onto a recording medium, plural tensioning rollers that stretch the intermediate transfer belt into a shape having two or more planar parts that the toner image carriers provided in the toner image formation units face and a displacement unit that changes a tensioned state of the intermediate transfer belt by changing a position of at least one of the plural tensioning rollers are provided, and at least one of the toner image carriers and the intermediate transfer belt are provided so as to be separated away from each other and make contact with each other as the tensioned state of the intermediate transfer belt changes.

SUMMARY

An image forming apparatus may include a transfer cylinder that rotates, a rotating member such as sprockets that rotates integrally with the transfer cylinder, and a circulating member such as chains that is suspended around the rotating member and circulates as the rotating member rotates. The image forming apparatus may further include an image forming part that forms an image and a transfer unit having a transfer belt onto which an image is transferred from the image forming part at a contact position with the image forming part and that transfers the image onto a recording medium transported by the circulating member by sandwiching the recording medium at a nip position together with the transfer cylinder.

In the image forming apparatus, vibration generated in the circulating member and the rotating member may undesirably propagate to the transfer unit having the transfer belt through the nip position between the transfer cylinder and the transfer belt, further propagate to the image forming part through the contact position between the transfer belt and the image forming part, and vibrate the image forming part.

Aspects of non-limiting embodiments of the present disclosure relate to reducing vibration of an image forming part as compared with a configuration in which a product of mass of a transfer cylinder and a distance from a center of mass of a transfer unit to a nip position is larger than a product of mass of the image forming part and a distance from the center of mass to a contact position.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including: a transfer cylinder that rotates; a rotating member that is coaxial with the transfer cylinder and rotates integrally with the transfer cylinder; a circulating member that is provided with a holding part that holds a front end portion of a recording medium, is suspended around the rotating member, and transports the recording medium by circulating as the rotating member rotates; an image forming part that forms an image; and a transfer unit having a transfer belt onto which the image is transferred from the image forming part at a contact position with the image forming part and that transfers the image onto the recording medium transported by the circulating member by sandwiching the recording medium together with the transfer cylinder at a nip position, wherein a product of mass of the transfer cylinder and a distance from a center of mass of the transfer unit to the nip position is smaller than a product of mass of the image forming part and a distance from the center of mass to the contact position.

BRIEF DESCRIPTION OF THE DRAWINGS

An exemplary embodiment of the present disclosure will be described in detail based on the following figures, wherein:

FIG. 4 is a table showing evaluation results of effects.

DETAILED DESCRIPTION

An exemplary embodiment of the present disclosure is described below with reference to the drawings.

Image Forming Apparatus 10

Figure 1:
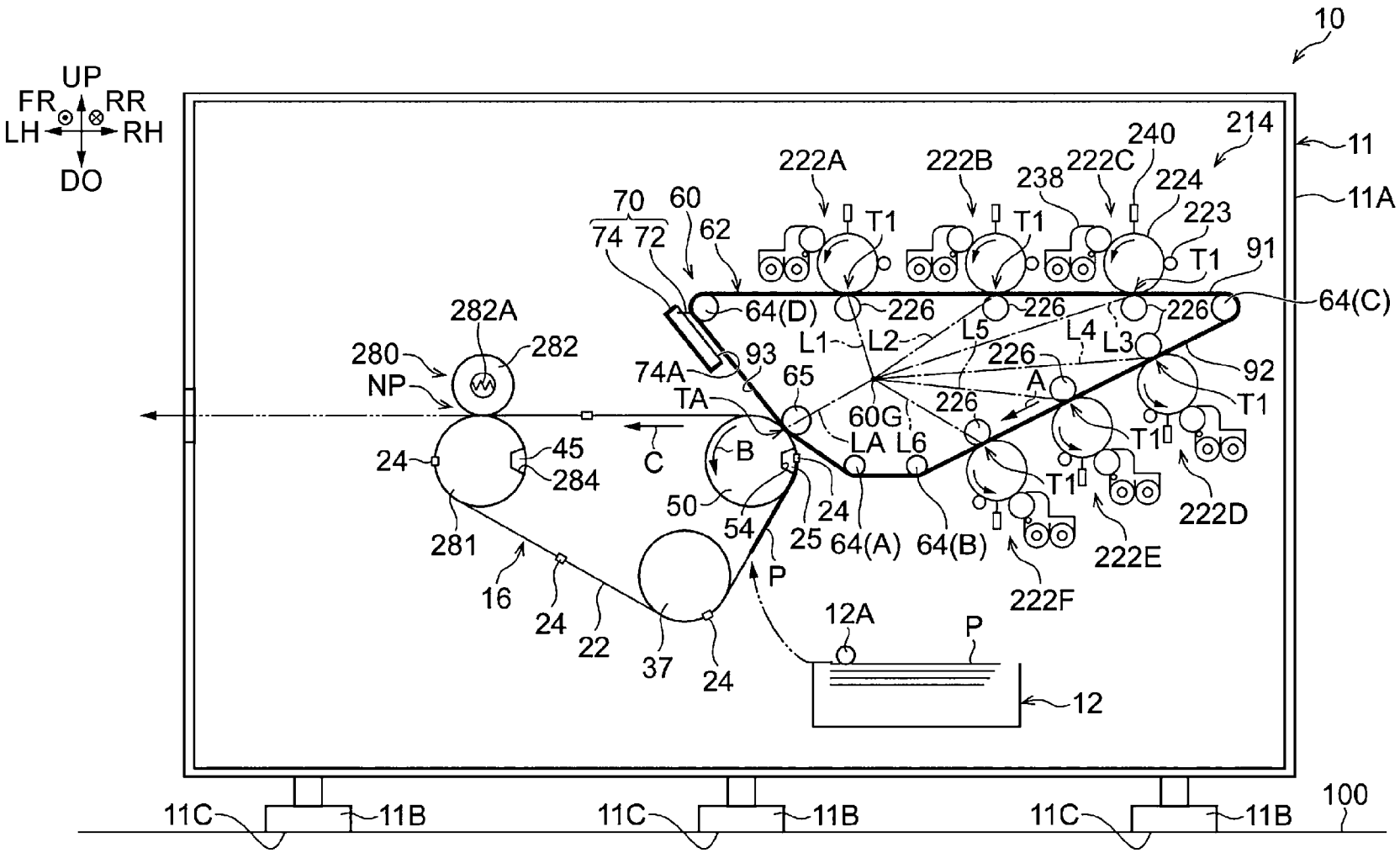
FIG. 1 is a schematic view illustrating a configuration of an image forming apparatus according to the present exemplary embodiment.

First, a configuration of an image forming apparatus 10 according to the present exemplary embodiment is described. FIG. 1 is a schematic view illustrating the configuration of the image forming apparatus 10 according to the present exemplary embodiment.

Note that arrow UP in the drawings indicates an upward direction (vertically upward direction) of the apparatus, and arrow DO indicates a downward direction (vertically downward direction) of the apparatus. Furthermore, arrow LH in the drawings indicates a leftward direction of the apparatus, and arrow RH indicates a rightward direction of the apparatus. Furthermore, arrow FR in the drawings indicates a frontward direction of the apparatus, and arrow RR indicates a rearward direction of the apparatus. These directions are directions set for convenience of description, and an apparatus configuration is not limited to these directions. Note that the wording "apparatus" may be omitted when the directions of the apparatus are mentioned. For example, the "upward direction of the apparatus" may be sometimes referred simply as an "upward direction".

In the following description, an "up-down direction" is sometimes used to refer to "both of the upward direction and the downward direction" or "either the upward direction or the downward direction". A "left-right direction" is sometimes used to refer to "both of the rightward direction and the leftward direction" or "either the rightward direction or the leftward direction". The "left-right direction" is also a lateral direction or a horizontal direction. A "front-rear direction" is sometimes used to refer to "both of the frontward direction and the rearward direction" or "either the frontward direction or the rearward direction". The front-rear direction corresponds to an axial direction of a sprocket 25, which will be described later, and is also a lateral direction or a horizontal direction. The up-down direction, the left-right direction, and the front-rear direction are directions crossing one another (specifically directions orthogonal to one another).

The symbol "○" having "×" therein in the drawings represents an arrow pointing from a near side toward a deeper side of the paper on which the drawings are drawn. Meanwhile, the symbol "○" having "·" therein in the drawings represents an arrow pointing from a deeper side toward a near side of the paper on which the drawings are drawn.

The image forming apparatus 10 illustrated in FIG. 1 is an electrophotographic image forming apparatus that forms a toner image (an example of an image) on a recording medium P. Specifically, the image forming apparatus 10 includes an image forming apparatus body 11, a medium storage part 12, a transport unit 16, and an image forming mechanism 214. The members (the image forming apparatus body 11, the medium storage part 12, the transport unit 16, and the image forming mechanism 214) of the image forming apparatus 10 are described.

Image Forming Apparatus Body 11

As illustrated in FIG. 1, the image forming apparatus body 11 is a part in which constituent parts of the image forming apparatus 10 are provided. Specifically, as illustrated in FIG. 1, the image forming apparatus body 11 has a housing 11A having a box shape and leg parts 11B provided on a lower end part of the housing 11A.

In the present exemplary embodiment, for example, the medium storage part 12, the image forming mechanism 214, and the transport unit 16 are provided in the housing 11A, as illustrated in FIG. 1. The leg parts 11B are provided on a bottom surface of the housing 11A. Bottom surfaces 11C of the leg parts 11B are in contact with a floor surface 100 on which the image forming apparatus 10 is provided. The housing 11A is supported by the leg parts 11B. Note that the image forming apparatus body 11 may be configured not to have the leg parts 11B.

Medium Storage Part 12

The medium storage part 12 is a part in which a recording medium P is stored in the image forming apparatus 10. A recording medium P stored in the medium storage part 12 is supplied to the transport unit 16. Specifically, a recording medium P stored in the medium storage part 12 is fed toward the transport unit 16 by a transport member 12A such as a transport roller.

The recording medium P is, for example, a sheet of paper. Note that the recording medium P is not limited to a sheet of paper, as long as the recording medium P is a medium on which an image can be formed. For example, the recording medium P may be a film.

Transport Unit 16

The transport unit 16 illustrated in FIG. 1 is a unit that transports a recording medium P. Note that the "unit" is a constituent unit constituting the image forming apparatus 10. That is, the "unit" is a constituent part handled as a single unit having a unity. In the present exemplary embodiment, the "unit" is a unit detachably attached to the image forming apparatus body 11. In other words, the "unit" is a unit integrally moved with respect to the image forming apparatus body 11.

Figure 2:
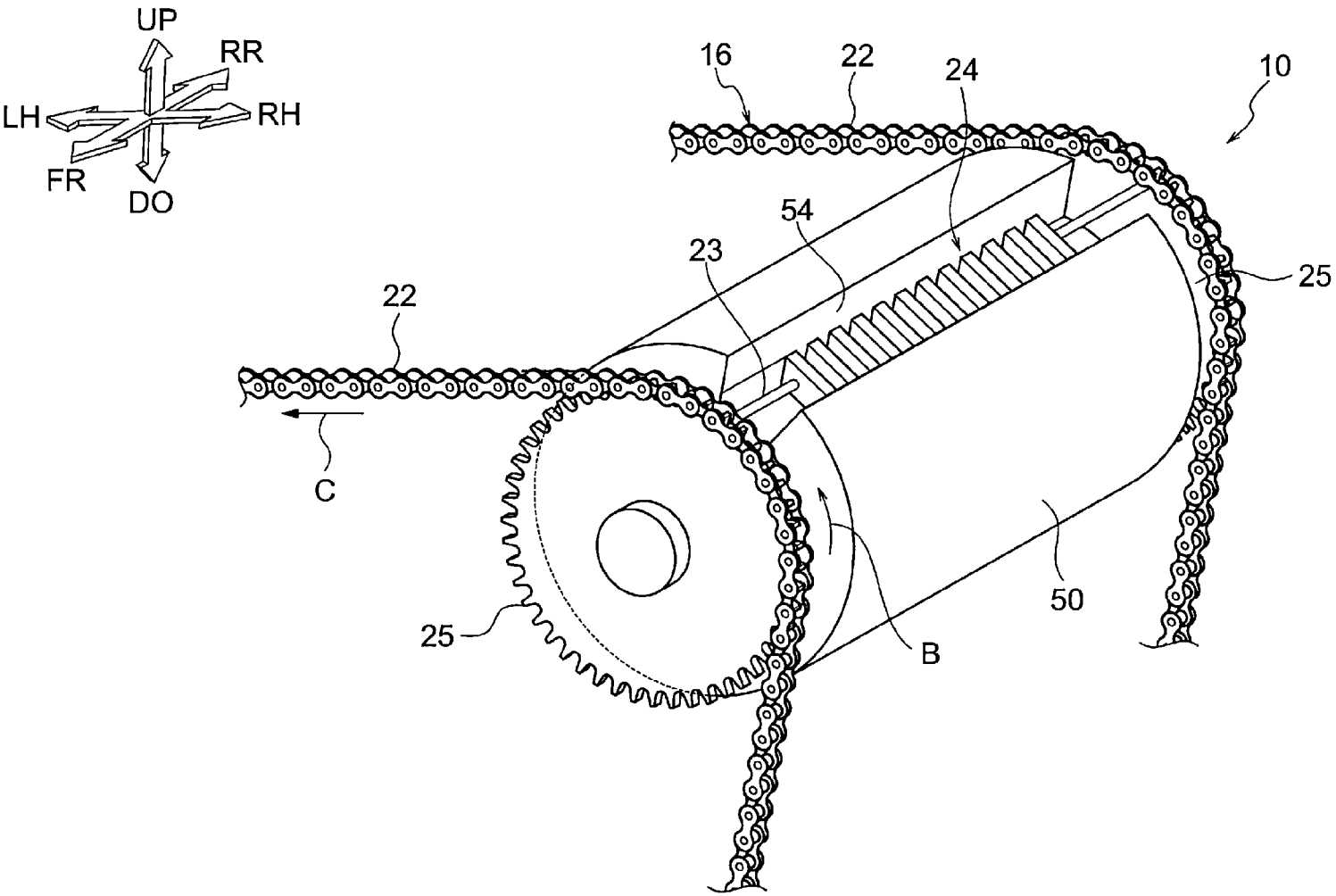
FIG. 2 is a perspective view illustrating configurations of chains, sprockets, and a transfer cylinder in the image forming apparatus according to the present exemplary embodiment.

Specifically, the transport unit 16 has a transfer cylinder 50, a pair of sprockets 25, a pair of chains 22, and grippers 24, as illustrated in FIGS. 1 and 2. Furthermore, the transport unit 16 has a pair of sprockets 37 and a pair of sprockets 45, as illustrated in FIG. 1. The pair of sprockets 25 are an example of a "rotating member". The pair of chains 22 are an example of a "circulating member". The grippers 24 are an example of a "holding part".

In FIG. 1, one of the pair of chains 22 is illustrated, and one of the pair of sprockets 25, one of the pair of sprockets 37, and one of the pair of sprockets 45 are illustrated. In FIG. 1, the sprockets 25, 37, and 45, the chains 22, the grippers 24, and others are illustrated in a simplified manner. In FIG. 2, the grippers 24 are illustrated in a simplified manner.

Transfer Cylinder 50

As illustrated in FIG. 2, the transfer cylinder 50 has a substantially cylindrical shape whose axial direction is the front-rear direction. In other words, the transfer cylinder 50 has a substantially circular shape in rearward view.

Note that the rearward view is a case where a target (the transfer cylinder 50 in this example) is viewed from a front side toward a rear side. That is, the rearward view is a case where the target is viewed toward a rear side, which is one side along an axial direction of the pair of sprockets 25.

As illustrated in FIGS. 1 and 2, the transfer cylinder 50 has a recessed part 54 on an outer circumferential surface thereof. In the present exemplary embodiment, a single recessed part 54 is provided in a part of the outer circumferential surface of the transfer cylinder 50 in a circumferential direction. This recessed part 54 is long along the axial direction of the transfer cylinder 50 and has a depth along a radial direction of the transfer cylinder 50. Specifically, the recessed part 54 is provided from one end to the other end of the transfer cylinder 50 in the axial direction. That is, the recessed part 54 is opened on the one end and the other end of the transfer cylinder 50 in the axial direction and passes through the transfer cylinder 50 in the axial direction.

Furthermore, as illustrated in FIG. 2, the recessed part 54 is a recessed part in which the grippers 24 are stored. Accordingly, the recessed part 54 is configured such that a depth thereof along the radial direction of the transfer cylinder 50 and a width thereof along the circumferential direction of the transfer cylinder 50 are larger than a size of the grippers 24. That is, the recessed part 54 according to the present exemplary embodiment is different from a microscopic recess formed on the outer circumferential surface of the transfer cylinder 50. Note that although a single recessed part 54 is provided in a part of the outer circumferential surface of the transfer cylinder 50 in the circumferential direction in the present exemplary embodiment, plural recessed parts 54 may be provided.

Pairs of Sprockets 25, 37, and 45 and Pair of Chains 22

As illustrated in FIG. 2, the pair of sprockets 25 are provided beside both ends of the transfer cylinder 50 in the axial direction. The pair of sprockets 25 are coaxial with the transfer cylinder 50 and rotates integrally with the transfer cylinder 50. The transfer cylinder 50 and the pair of sprockets 25 are driven to rotate by a driving part (not illustrated).

As illustrated in FIG. 1, the pair of sprockets 45 are disposed on a left side (i.e., on a downstream side in a transport direction) relative to the pair of sprockets 25. The pair of sprockets 45 are disposed so as to be spaced apart from each other in the front-rear direction.

The pair of sprockets 37 are disposed on a lower side relative to the pair of sprockets 25 and the pair of sprockets 45 and on a left side (i.e., on a pair of sprockets 45 side) relative to the pair of sprockets 25. The pair of sprockets 37 are disposed so as to be spaced apart from each other in the front-rear direction.

As illustrated in FIG. 1, the pair of chains 22 have an annular shape. As illustrated in FIG. 2, the pair of chains 22 are disposed so as to be spaced apart from each other in the front-rear direction. Each of chains 22 is suspended around a corresponding one of sprockets 25, a corresponding one of sprockets 37, and a corresponding one of sprockets 45. That is, each of chains 22 is engaged with a corresponding one of sprockets 25, a corresponding one of sprockets 37, and a corresponding one of sprockets 45.

The transfer cylinder 50 and the pair of sprockets 25 are driven to rotate integrally in a rotation direction B (a direction indicated by arrow B in FIGS. 1 and 2), and thereby the pairs of sprockets 37 and 45 rotate and the pair of chains 22 circulate in a circulation direction C (a direction indicated by arrow C in FIGS. 1 and 2). That is, the pair of chains 22 circulate as the pairs of sprockets 25, 37, and 45 rotate.

Grippers 24

Figure 3:
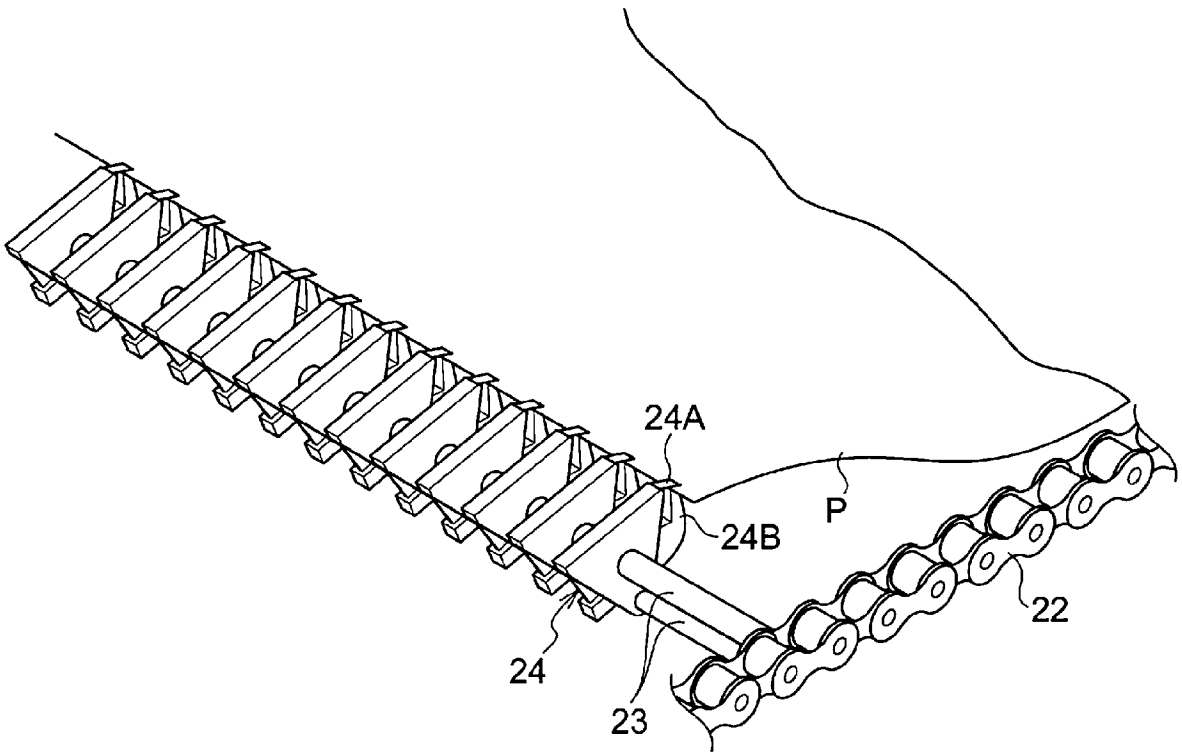
FIG. 3 is a perspective view illustrating a state where a recording medium is held by grippers of the image forming apparatus according to the present exemplary embodiment.

As illustrated in FIG. 3, the grippers 24 function as a holding part that holds a front end portion of a recording medium P. As illustrated in FIG. 2, the grippers 24 are attached to an attachment member 23 provided along the front-rear direction between the pair of chains 22. That is, the grippers 24 are provided on the chains 22 with the attachment member 23 interposed therebetween.

Plural attachment members 23 are disposed at predetermined intervals along the circulation direction C of the chains 22. One end and the other end of each of the attachment members 23 in a longitudinal direction are attached to the pair of chains 22, respectively.

As illustrated in FIG. 2, the grippers 24 are attached to each of the attachment members 23 at predetermined intervals along the front-rear direction. As illustrated in FIG. 3, each of the grippers 24 has a claw 24A and a claw rest 24B. Each of the grippers 24 is configured to hold a recording medium P by nipping a front end portion of the recording medium P between the claw 24A and the claw rest 24B. Note that each of the grippers 24 is, for example, configured such that the claw 24A is pressed against the claw rest 24B by a spring or the like and the claw 24A is opened and closed relative to the claw rest 24B by action of a cam or the like.

Although the grippers 24, which are an example of a holding part, hold a front end portion of a recording medium P on a downstream side in the transport direction in the present exemplary embodiment, this is not restrictive. The holding part may be any holding part that holds a front end portion of a recording medium P and may be, for example, a holding part that holds a front end portion of a recording medium P from both sides of the recording medium P.

In the transport unit 16, a front end portion of a recording medium P supplied from the medium storage part 12 in which recording media P are stored is held by the grippers 24 as illustrated in FIG. 3. The chains 22 circulate in the circulation direction C in a state where the grippers 24 hold the front end portion of the recording medium P, and thereby the recording medium P is transported to pass a transfer position TA, which will be described later, and a fixation position NP, which will be described later. The grippers 24 pass the transfer position TA (i.e., between the transfer cylinder 50 and an opposed roller 65), which will be described later, while being stored in the recessed part 54 of the transfer cylinder 50. Furthermore, the grippers 24 pass the fixation position NP, which will be described later, while being stored in a recessed part 284 of a pressing roller 281, which will be described later.

Image Forming Mechanism 214

The image forming mechanism 214 illustrated in FIG. 1 has a function of forming an image on the recording medium P. Specifically, the image forming mechanism 214 forms an image on a recording medium P transported by the transport unit 16 by using toner. More specifically, as illustrated in FIG. 1, the image forming mechanism 214 has toner image forming units 222A, 222B, 222C, 222D, 222E, and 222F (hereinafter referred to as 222A to 222F) that form toner images, a transfer unit 60 having a transfer belt 62, and a fixation device 280.

Toner Image Forming Units 222A to 222F

Each of the toner image forming units 222A to 222F illustrated in FIG. 1 has a function of forming an image to be transferred from the transfer belt 62 onto a recording medium P. Specifically, the toner image forming units 222A to 222F form images of predetermined colors by using toner of the predetermined colors. The predetermined colors include yellow (Y), magenta (M), cyan (C), and black (K). Note that the toner image forming units 222A to 222F are an example of an "image forming part".

In the present exemplary embodiment, the toner image forming units 222A to 222F have similar configurations except for used toner, and therefore parts of the toner image forming unit 222C as a representative of the toner image forming units 222A to 222F are given reference signs in FIG. 1.

Specifically, each of the toner image forming units 222A to 222F has a photoreceptor 224 that rotates in one direction (e.g., a counterclockwise direction in FIG. 1). Furthermore, each of the toner image forming units 222A to 222F has a charging device 223, an exposure device 240, and a developing device 238.

In each of the toner image forming units 222A to 222F, the charging device 223 charges the photoreceptor 224. Furthermore, the exposure device 240 forms an electrostatic latent image on the photoreceptor 224 by exposing the photoreceptor 224 charged by the charging device 223 to light. Furthermore, the developing device 238 forms a toner image by developing the electrostatic latent image formed on the photoreceptor 224 by the exposure device 240.

Note that each of the toner image forming units 222A to 222F further has a support (not illustrated) that supports members (specifically, the photoreceptor 224, the charging device 223, the exposure device 240, the developing device 238, and others) of each of the toner image forming units 222A to 222F. The support has a support frame (not illustrated) disposed on a front side and a rear side relative to the photoreceptor 224. The toner image forming units 222A to 222F may be any units that have at least the photoreceptor 224.

Transfer Unit 60

The transfer unit 60 is a unit having the transfer belt 62 that transfers an image onto a recording medium P, as described above. Specifically, the transfer unit 60 first-transfers toner images on the photoreceptors 224 of respective colors onto the transfer belt 62 serving as an intermediate transfer body and then second-transfers the toner images onto a recording medium P. More specifically, the transfer unit 60 has first transfer rollers 226, the transfer belt 62, an opposed roller 65, plural support rollers 64, and a cleaning part 70.

Note that the transfer unit 60 further has a support (not illustrated) that supports the members (specifically, the transfer belt 62, the opposed roller 65, the plural support rollers 64, the cleaning part 70, and other members) of the transfer unit 60. The support has a support frame (not illustrated) disposed on a front side and a rear side relative to the transfer belt 62.

First Transfer Roller 226

Each of the first transfer rollers 226 is a roller that transfers a toner image on the photoreceptor 224 of each of the toner image forming units 222A to 222F onto the transfer belt 62 at a first transfer position T1 between the photoreceptor 224 and the first transfer roller 226. Specifically, each of the first transfer rollers 226 sandwiches the transfer belt 62 together with the photoreceptor 224 at the first transfer position T1. Accordingly, the photoreceptor 224 of each of the toner image forming units 222A to 222F and the transfer belt 62 are in contact with each other at the first transfer position T1. The first transfer position T1 is an example of a "contact position".

In the present exemplary embodiment, a first transfer electric field is applied between the first transfer roller 226 and the photoreceptor 224, and thereby a toner image formed on the photoreceptor 224 is transferred onto the transfer belt 62 at the first transfer position T1.

Transfer Belt 62, Opposed Roller 65, and Plural Support Rollers 64

The transfer belt 62 has an annular shape (specifically, an endless shape), and is suspended around the opposed roller 65 and the plural support rollers 64 and is thereby supported by the opposed roller 65 and the plural support rollers 64.

The opposed roller 65 is disposed so as to face the transfer cylinder 50 with the transfer belt 62 interposed therebetween. Specifically, the opposed roller 65 is disposed on an upper right side relative to the transfer cylinder 50. The opposed roller 65 is pressed against the outer circumferential surface of the transfer cylinder 50 with the transfer belt 62 interposed therebetween, for example, by elastic force of an elastic member (not illustrated).

In the present exemplary embodiment, a position where the opposed roller 65 faces the transfer cylinder 50 is the transfer position TA where an image is transferred onto the recording medium P. The transfer position TA is an example of a "nip position". The transfer position TA may also be referred to as an image formation position since an image is transferred and formed on a recording medium P at the transfer position TA.

Specifically, four support rollers 64 are provided on an inner circumferential side of the transfer belt 62, as indicated by reference signs (A), (B), (C), and (D) in FIG. 1. The support rollers 64(A) and 64(B) are disposed side by side along the left-right direction on a lower side and a right side relative to the transfer position TA. The support roller 64(C) is disposed on an upper side and a right side relative to the transfer position TA. The support roller 64(D) is disposed on an upper side and a left side relative to the transfer position TA. The support rollers 64(C) and 64(D) are disposed side by side along the left-right direction.

The transfer belt 62 is suspended around the opposed roller 65 and the four support rollers 64 and thereby forms a substantially pentagonal shape formed by five faces including a first face 91, a second face 92, and a third face 93 in rearward view.

The first face 91 of the transfer belt 62 is a face that faces an upper side between the support roller 64(C) and the support roller 64(D). The second face 92 of the transfer belt 62 is a face that faces a lower right side between the support roller 64(B) and the support roller 64(C). The third face 93 of the transfer belt 62 is a face that faces a lower left side between the opposed roller 65 and the support roller 64(D). The first face 91 is disposed on a downstream side relative to the third face 93 and on an upstream side relative to the second face 92 in the circulation direction A of the transfer belt 62. The second face 92 is disposed on a downstream side relative to the first face 91 and on an upstream side relative to the transfer position TA in the circulation direction A of the transfer belt 62.

The toner image forming units 222A, 222B, and 222C face the first face 91 of the transfer belt 62, and the photoreceptors 224 of the toner image forming units 222A, 222B, and 222C are in contact with the first face 91 of the transfer belt 62. Furthermore, the toner image forming units 222D, 222E, and 222F face the second face 92 of the transfer belt 62, and the photoreceptors 224 of the toner image forming units 222D, 222E, and 222F are in contact with the second face 92 of the transfer belt 62.

In the present exemplary embodiment, the toner image forming units 222A to 222F are disposed in this order along the circulation direction A of the transfer belt 62. It can therefore be said that the toner image forming units 222A to 222F are disposed as follows. Specifically, the toner image forming units 222B, 222C, 222D, 222E, and 222F are disposed on a downstream side relative to the toner image forming unit 222A and on an upstream side relative to the transfer position TA in the circulation direction A of the transfer belt 62. The toner image forming units 222C, 222D, 222E, and 222F are disposed on a downstream side relative to the toner image forming unit 222B and on an upstream side relative to the transfer position TA in the circulation direction A of the transfer belt 62. The toner image forming units 222D, 222E, and 222F are disposed on a downstream side relative to the toner image forming unit 222C and on an upstream side relative to the transfer position TA in the circulation direction A of the transfer belt 62. The toner image forming units 222E and 222F are disposed on a downstream side relative to the toner image forming unit 222D and on an upstream side relative to the transfer position TA in the circulation direction A of the transfer belt 62. The toner image forming units 222F is disposed on a downstream side relative to the toner image forming units 222E and on an upstream side relative to the transfer position TA in the circulation direction A of the transfer belt 62.

Of the four support rollers 64, the support roller 64(D) is a driving roller that transmits driving force to the transfer belt 62. The support roller 64(D) is driven to rotate by a driving motor (not illustrated). The support roller 64(D) is a solid support roller. Meanwhile, the support rollers 64(A), 64(B), and 64(C) are hollow support rollers and driven rollers. Accordingly, mass of the support roller 64(D) is larger than mass of each of the support rollers 64(A), 64(B), and 64(C). Note that a hollow support roller is a support roller that has a hollow space therein, and a solid support roller is a support roller that has no hollow space therein.

When the support roller 64(D) is driven to rotate, the transfer belt 62 circulates in the circulation direction A (the direction indicated by arrow A in FIG. 1). The circulating transfer belt 62 sandwiches a recording medium P transported by the transport unit 16 together with the transfer cylinder 50 at the transfer position TA and thereby transfers images formed on the outer circumferential surface thereof onto the recording medium P upon application of a second transfer electric field between the opposed roller 65 and the transfer cylinder 50. In this way, an image is formed on the recording medium P.

Cleaning Part 70

The cleaning part 70 has a function of cleaning the transfer belt 62. Specifically, the cleaning part 70 has a function of removing a foreign substance attached on the transfer belt 62. Examples of the foreign substance include paper powder generated from a sheet of paper, which is an example of a recording medium P, and toner.

As illustrated in FIG. 1, the cleaning part 70 is disposed so as to face the third face 93 of the transfer belt 62. The cleaning part 70 has a blade 72 and a housing 74 in which the blade 72 is disposed.

The blade 72 has a function as an example of a contact part that removes a foreign substance from the transfer belt 62 by making contact with the transfer belt 62. Specifically, the blade 72 makes contact with a portion of the transfer belt 62 that is suspended around the support roller 64(D). That is, the blade 72 is disposed so as to face the support roller 64(D) with the transfer belt 62 interposed therebetween. In the present exemplary embodiment, the blade 72 removes a foreign substance from the transfer belt 62 by making contact with the portion of the transfer belt 62 that is suspended around the support roller 64(D) and scraping away the foreign substance attached on the transfer belt 62.

The housing 74 has an opening 74A on a side facing the third face 93 of the transfer belt 62 (i.e., on a side facing the support roller 64(D)), and a foreign substance removed by the blade 72 is stored in the housing 74 through the opening 74A.

Note that an example of the contact part that makes contact with the transfer belt 62 is not limited to the blade 72. The contact part may be any part that can remove a foreign substance from the transfer belt 62 and may be, for example, a brush. The blade 72, which is an example of the contact part, may be configured to make contact with a portion of the transfer belt 62 that is not suspended around the support roller 64. In this case, a member such as a roller is disposed so as to face the blade 72 with the transfer belt 62 interposed therebetween.

Fixation Device 280

The fixation device 280 has a function of fixing, on a recording medium P, a toner image transferred onto the recording medium P. Specifically, as illustrated in FIG. 1, the fixation device 280 has the pressing roller 281 and a heating roller 282.

In the present exemplary embodiment, a pair of sprockets 45 are provided beside both ends of the pressing roller 281 in an axial direction, respectively. The pair of sprockets 45 are coaxial with the pressing roller 281 and rotate integrally with the pressing roller 281. Furthermore, the pressing roller 281 has, on an outer circumference thereof, the recessed part 284 in which grippers 24 and an attachment member 23 are stored.

In the fixation device 280, the heating roller 282 is disposed on an upper side relative to the pressing roller 281. The heating roller 282 has a heating source 282A such as a halogen lamp therein.

In the fixation device 280, a recording medium P is heated and pressed while being transported between the heating roller 282 and the pressing roller 281, and thereby a toner image transferred onto the recording medium P is fixed on the recording medium P at the fixation position NP.

Relationship of Product of Mass and Distance in Each Part of Image Forming Apparatus 10

In the present exemplary embodiment, a product of mass of the transfer cylinder 50 and a distance LA from a center of mass 60G of the transfer unit 60 to the transfer position TA is smaller than a product of mass of each of the toner image forming units 222A to 222F and a corresponding one of distances L1, L2, L3, L4, L5, and L6 (hereinafter referred to as L1 to L6) from the center of mass 60G to the corresponding first transfer position T1.

The mass of the transfer cylinder 50 is at least smaller than the mass of each of the toner image forming units 222A to 222F. Specifically, the mass of the transfer cylinder 50 is, for example, within a range of 50 kg or larger and 60 kg or smaller.

The mass of each of the toner image forming units 222A to 222F is at least larger than the mass of the transfer cylinder 50. The mass of each of the toner image forming units 222A to 222F is, for example, two times as large as the mass of the transfer cylinder 50 or larger. The mass of each of the toner image forming units 222A to 222F is, for example, 100 kg or larger. Specifically, the mass of each of the toner image forming units 222A to 222F is, for example, within a range of 100 kg or larger and 150 kg or smaller.

The center of mass 60G of the transfer unit 60 is a point where total force of gravity working on the parts of the transfer unit 60 acts.

The distance LA and the distances L1 to L6 are distances in rearward view. Furthermore, the "distance to the transfer position TA" is a distance to a center of the transfer position TA in the circulation direction A in a case where the transfer position TA has a width in the circulation direction A of the transfer belt 62.

The "distance to the first transfer position T1" is a distance to a center of the first transfer position T1 in the circulation direction A in a case where the first transfer position T1 has a width in the circulation direction A of the transfer belt 62.

When the distance LA and the distances L1 to L6 are arranged in an ascending order, these distances are arranged, for example, as follows: the distance L1, the distance L2, the distance L6, the distance LA, the distance L5, the distance L3, the distance L4. The distance L1 is, for example, 200 mm or more and less than 300 mm. The distance L2 is, for example, more than 300 mm and less than 400 mm. The distance L6 is, for example, more than 400 mm and less than 450 mm. The distance LA is, for example, more than 450 mm and less than 550 mm. The distance L5 is, for example, more than 550 mm and less than 650 mm. The distance L3 is, for example, more than 650 mm and less than 800 mm. The distance L4 is, for example, more than 800 mm and less than 900 mm.

Furthermore, in the present exemplary embodiment, when the products of the mass of the toner image forming units 222A to 222F and the distances L1 to L6 are arranged in an ascending order, these products are arranged as follows: the product of the mass of the toner image forming unit 222A and the distance L1, the product of the mass of the toner image forming unit 222B and the distance L2, the product of the mass of the toner image forming unit 222F and the distance L6, the product of the mass of the toner image forming unit 222E and the distance L5, the product of the mass of the toner image forming unit 222C and the distance L3, and the product of the mass of the toner image forming unit 222D and the distance L4.

The toner image forming unit 222A is an example of a "first image forming part". The toner image forming unit 222B is an example of a "second image forming part". The toner image forming unit 222C is an example of a "third image forming part".

Note that in a case where the toner image forming unit 222A and the toner image forming unit 222B are grasped as an example of the "first image forming part" and an example of the "second image forming part", respectively, any of the toner image forming units 222D, 222E, and 222F may be grasped as an example of the "third image forming part". The toner image forming unit 222B, the toner image forming unit 222C, and the toner image forming unit 222D may be grasped as an example of the "first image forming part", an example of the "second image forming part", and an example of the "third image forming part", respectively.

Furthermore, in a case where the toner image forming unit 222A is grasped as an example of the "first image forming part", any of the toner image forming units 222C, 222D, 222E, and 222F may be grasped as an example of the "second image forming part". Furthermore, in a case where the toner image forming unit 222B is grasped as an example of the "first image forming part", any of the toner image forming units 222C, 222D, 222E, and 222F may be grasped as an example of the "second image forming part". Furthermore, the toner image forming unit 222C and the toner image forming unit 222D may be grasped as an example of the "first image forming part" and an example of the "second image forming part", respectively.

Mass of Transport Unit 16 and Transfer Unit 60

Mass of the transport unit 16 including the transfer cylinder 50, the pairs of sprockets 25, 37, and 45, the pair of chains 22, and the grippers 24 is two times as large as mass of the transfer unit 60 or larger. Specifically, the mass of the transfer unit 60 is 300 kg, and the mass of the transport unit 16 is, for example, 600 kg.

Operation According to Present Exemplary Embodiment

Next, operation according to the present exemplary embodiment is described.

In the image forming apparatus 10, a front end portion of a recording medium P fed from the medium storage part 12 in which recording media P are stored is held by the grippers 24, as illustrated in FIG. 3. In the state where the grippers 24 are holding the front end portion of the recording medium P, the chains 22 circulate in the circulation direction C. This causes the recording medium P to be transported and pass the transfer position TA. The grippers 24 pass the position between the transfer cylinder 50 and the opposed roller 65 while being stored in the recessed part 54 of the transfer cylinder 50. The transfer belt 62 transfers an image formed on an outer circumferential surface thereof onto the recording medium P by sandwiching the recording medium P together with the transfer cylinder 50 at the transfer position TA.

Furthermore, the chains 22 circulate in the circulation direction C in the state where the grippers 24 are holding the front end portion of the recording medium P, and thereby the recording medium P is transported to pass the fixation position NP. The grippers 24 pass the position between the heating roller 282 and the pressing roller 281 while being stored in the recessed part 284 of the pressing roller 281. Then, the recording medium P is heated and pressed while being transported between the heating roller 282 and the pressing roller 281, and thereby a toner image transferred onto the recording medium P is fixed on the recording medium P. In this way, an image is formed on the recording medium P.

In the image forming apparatus 10, vibration generated in the members such as the chains 22 and the sprockets 25 during transport of the recording medium P propagates from the transfer cylinder 50 to the transfer unit 60 having the transfer belt 62 through the transfer position TA. The vibration that has propagated to the transfer unit 60 may undesirably further propagate to the toner image forming units 222A to 222F through the first transfer positions T1 and vibrate the toner image forming units 222A to 222F.

In particular, since the opposed roller 65 is pressed against the outer circumferential surface of the transfer cylinder 50 with the transfer belt 62 interposed therebetween in the present exemplary embodiment, vibration is likely to be generated at the transfer position TA due to a step of the recessed part 54 when the recessed part 54 of the transfer cylinder 50 passes the transfer position TA (hereinafter referred to as a cause A).

Furthermore, since the mass of the transport unit 16 is two times as large as the mass of the transfer unit 60 or larger in the present exemplary embodiment, the transfer unit 60 is likely to vibrate due to the vibration generated in the transport unit 16 (hereinafter referred to as a cause B).

Furthermore, since the mass of each of the toner image forming units 222A to 222F is 100 kg or larger in the present exemplary embodiment, the image forming apparatus 10 becomes large in size, and therefore the transfer unit 60 is likely to be vibrated (hereinafter referred to as a cause C). When the transfer unit 60 is vibrated, the toner image forming units 222A to 222F are also vibrated. As a result, an image defect such as banding occurs in an image transferred from the transfer belt 62 onto the recording medium P. Note that the banding is an image defect that appears as deep and pale stripes.

In the present exemplary embodiment, the product of the mass of the transfer cylinder 50 and the distance LA from the center of mass 60G of the transfer unit 60 to the transfer position TA is smaller than the product of the mass of each of the toner image forming units 222A to 222F and a corresponding one of the distances L1 to L6 from the center of mass 60G to the corresponding first transfer position T1.

The product can be regarded as vibration energy. In other words, a position (specifically, the transfer position TA or the first transfer position T1) that is larger in the product is harder to vibrate in a case where vibration propagates from the center of mass 60G, and outputs larger vibration to the center of mass 60G when the position serves as a vibration source.

Accordingly, according to the present exemplary embodiment, it can be said that vibration energy input from the transfer position TA to the center of mass 60G is smaller than vibration energy input from the first transfer position T1 to the center of mass 60G. Meanwhile, in a case where vibration propagates from the center of mass 60G, each first transfer position T1 is harder to vibrate than the transfer position TA.

Accordingly, according to the present exemplary embodiment, vibration of each of the toner image forming units 222A to 222F is reduced as compared with a configuration (hereinafter referred to as a configuration A) in which the product of the mass of the transfer cylinder 50 and the distance LA from the center of mass 60G of the transfer unit 60 to the transfer position TA is larger than the product of the mass of each of the toner image forming units 222A to 222F and a corresponding one of the distances L1 to L6 from the center of mass 60G to the corresponding first transfer position T1.

As a result, according to the present exemplary embodiment, vibration of the toner image forming units 222A to 222F is reduced, and occurrence of an image defect of an image formed on a recording medium P is reduced as compared with the configuration A although the configuration in which the toner image forming units 222A to 222F are likely to be vibrated due to the causes A, B, and C is employed.

Furthermore, in the present exemplary embodiment, the product of the mass of the toner image forming unit 222B and the distance L2 is larger than the product of the mass of the toner image forming unit 222A and the distance L1.

Accordingly, vibration is reduced at a first transfer position T1 at which an image is transferred onto the transfer belt 62 later, and therefore an image defect such as banding is less noticeable in an image formed on the transfer belt 62.

As a result, an image defect such as banding occurring in an image transferred onto a recording medium P is less noticeable than in a configuration in which the product of the mass of the toner image forming unit 222B and the distance L2 is smaller than the product of the mass of the toner image forming unit 222A and the distance L1.

Furthermore, in the present exemplary embodiment, the product of the mass of the toner image forming unit 222C and the distance L3 is larger than the product of the mass of the toner image forming unit 222B and the distance L2.

Accordingly, vibration is reduced at a first transfer position T1 at which an image is transferred onto the transfer belt 62 later, and therefore an image defect such as banding is less noticeable in an image formed on the transfer belt 62.

As a result, an image defect such as banding occurring in an image transferred onto a recording medium P is less noticeable than in a configuration in which the product of the mass of the toner image forming unit 222C and the distance L3 is smaller than the product of the mass of the toner image forming unit 222*b* and the distance L2.

Evaluation

In evaluation, an image was formed on a recording medium P while changing a relationship between mass and a distance in the toner image forming units 222A to 222F and the transfer cylinder 50 in the configuration of the present exemplary embodiment, and occurrence of banding in the image was evaluated.

In the evaluation, a half-tone image (image density 20%) of each color was formed on the recording medium P by using the toner image forming units 222A to 222F, and occurrence of banding was visually checked.

Evaluation Criteria

A: occurrence of banding cannot be confirmed

B: occurrence of banding can be slightly confirmed

C: occurrence of banding can be markedly confirmed

EXAMPLE 1

As shown in the table of FIG. 4, the product of the mass of the transfer cylinder 50 and the distance LA from the center of mass 60G of the transfer unit 60 to the transfer position TA is set smaller than the product of the mass of each of the toner image forming units 222A to 222F and a corresponding one of the distances L1 to L6 from the center of mass 60G to the corresponding first transfer position T1.

EXAMPLE 2

As shown in the table of FIG. 4, the product of the mass of the transfer cylinder 50 and the distance LA from the center of mass 60G of the transfer unit 60 to the transfer position TA is set larger than the product of the mass of each of the toner image forming units 222A, 222B, 222E, and 222F and a corresponding one of the distances L1, L2, L5, and L6 from the center of mass 60G to the corresponding first transfer position T1 and is set smaller than the product of the mass of each of the toner image forming units 222C and 222D and a corresponding one of the distances L3 and L4 from the center of mass 60G to the corresponding first transfer position T1.

COMPARATIVE EXAMPLE 1

As shown in the table of FIG. 4, the product of the mass of the transfer cylinder 50 and the distance LA from the center of mass 60G of the transfer unit 60 to the transfer position TA is set larger than the product of the mass of each of the toner image forming units 222A to 222F and a corresponding one of the distances L1 to L6 from the center of mass 60G to the corresponding first transfer position T1.

Evaluation Results

As illustrated in FIG. 4, in Comparative Example 1, occurrence of banding was remarkably confirmed. Meanwhile, in Example 1, occurrence of banding was not confirmed. In Example 2, occurrence of banding was slightly confirmed. The banding is considered to occur due to vibration of the transfer unit 60. Therefore, the results illustrated in FIG. 4 indicate that vibration of the transfer unit 60 was reduced in Examples 1 and 2 as compared with Comparative Example 1.

Modifications

Although the product of the mass of the toner image forming unit 222B and the distance L2 is larger than the product of the mass of the toner image forming unit 222A and the distance L1 in the present exemplary embodiment, this is not restrictive. The product of the mass of the toner image forming unit 222B and the distance L2 may be smaller than the product of the mass of the toner image forming unit 222A and the distance L1.

Furthermore, although the product of the mass of the toner image forming unit 222C and the distance L3 is larger than the product of the mass of the toner image forming unit 222B and the distance L2, this is not restrictive. For example, the product of the toner image forming unit 222C and the distance L3 may be smaller than the product of the toner image forming unit 222B and the distance L2. That is, the relationship in the product among the toner image forming units 222A to 222F is not limited to the one described above.

Furthermore, although the product of the mass of the transfer cylinder 50 and the distance LA from the center of mass 60 of the transfer unit 60 to the transfer position TA is smaller than the product of the mass of each of the toner image forming units 222A to 222F and a corresponding one of the distances L1 to L6 from the center of mass 60G to the corresponding first transfer position T1 in the present exemplary embodiment, this is not restrictive. It is only necessary that the product of the mass of the transfer cylinder 50 and the distance LA from the center of mass 60 of the transfer unit 60 to the transfer position TA is smaller than the product in at least one of the toner image forming units 222A to 222F. Therefore, for example, in a case where the toner image forming units 222A to 222F are configured as toner image forming units that form toner images of six colors, specifically, yellow (Y), magenta (M), cyan (C), black (K), and two special colors, the product in one or some of the toner image forming units of the six colors may be smaller than the product in the transfer cylinder 50. In this case, for example, it is possible to employ a configuration (hereinafter referred to as a configuration X) in which the product in a toner image forming unit of a color that has small influence on image quality among the toner image forming units 222A to 222F of the six colors is smaller than the product in the transfer cylinder 50 and the product in a toner image forming unit of a color that has large influence on image quality among the toner image forming units 222A to 222F of the six colors is larger than the product in the transfer cylinder 50. Specifically, the configuration X may be, for example, a configuration in which the product in a toner image forming unit of a transparent color, which is a special color, is smaller than the product in the transfer cylinder 50 and the product in each of the toner image forming units of yellow (Y), magenta (M), cyan (C), and black (K) is larger than the product in the transfer cylinder 50. Furthermore, the configuration X may be, for example, a configuration in which the product in the toner image forming unit of black (K) is smaller than the product in the transfer cylinder 50 and the product in each of the toner image forming units of yellow (Y), magenta (M), and cyan (C) is larger than the product in the transfer cylinder 50. The configuration X can be realized, for example, by disposing a toner image forming unit of a color that has small influence on image quality among the toner image forming units 222A to 222F of the six colors at a position closest to the center of mass 60G and disposing a toner image forming unit of a color that has larger influence on image quality among the toner image forming units 222A to 222F of the six colors at a position farther from the center of mass 60G. Examples of the special colors include transparent, white, gold, silver, violet, green, orange, light magenta, light cyan, and gray.

Although the transfer cylinder 50 has the recessed part 54 on the outer circumferential surface thereof in the present exemplary embodiment, this is not restrictive. For example, the transfer cylinder 50 that does not have the recessed part 54 may be used. In this case, for example, a front end portion of a recording medium P is held from both sides of the recording medium P by a holding part disposed at both ends of the transfer cylinder 50 in the axial direction. That is, a holding part that does not need to be stored in the recessed part 54 is used. Furthermore, the recessed part 54 provided on the outer circumferential surface of the transfer cylinder 50 may be a recessed part used for use other than storing the grippers 24, which are an example of a holding part.

Although the chains 22 are used as an example of a circulating member and the sprockets 25 are used as an example of a rotating member in the present exemplary embodiment, this is not restrictive. For example, a timing belt having recessed and raised parts on an inner circumference may be used as an example of a circulating member, and a timing pulley (i.e., a pulley having recessed and raised parts on an outer circumference) may be used as an example of a rotating member. Furthermore, a belt may be used as an example of a circulating member, and a pulley that causes the belt to circulate due to friction may be used as an example of a rotating member.

Although the mass of the transport unit 16 is two times as large as the mass of the transfer unit 60 or larger in the present exemplary embodiment, this is not restrictive. For example, the mass of the transport unit 16 may be less than two times as large as the mass of the transfer unit 60.

Although the mass of each of the toner image forming units 222A to 222F is 100 kg or more in the present exemplary embodiment, this is not restrictive. For example, the mass of each of the toner image forming units 222A to 222F may be less than 100 kg.

The present disclosure is not limited to the above exemplary embodiments and can be modified, changed, or improved in various ways without departing from the spirit of the present disclosure. For example, the modifications described above may be combined as appropriate.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a transfer cylinder configured to rotate;

a sprocket that is coaxial with the transfer cylinder and is configured to rotate integrally with the transfer cylinder;

a chain that is provided with a gripper that is configured to hold a front end portion of a recording medium, is suspended around the sprocket, and is configured to transport the recording medium by circulating as the sprocket rotates;

an image forming part comprising a photoreceptor, wherein the image forming part is configured to form an image; and a transfer unit having a transfer belt configured to transfer the image from the image forming part at a contact position with the image forming part and is configured to transfer the image onto the recording medium transported by the chain by sandwiching the recording medium together with the transfer cylinder at a nip position, wherein a product of mass of the transfer cylinder and a distance from a center of mass of the transfer unit to the nip position is smaller than a product of mass of the image forming part and a distance from the center of mass to the contact position.

2. The image forming apparatus according to claim 1, wherein:

the image forming part comprises:

a first image forming part comprising a first photoconductor; and a second image forming part comprising a second photoconductor that is disposed on a downstream side relative to the first image forming part in a circulation direction of the transfer belt and on an upstream side relative to the nip position in the circulation direction of the transfer belt; and a product of mass of the second image forming part and a distance from the center of mass to the contact position is larger than a product of mass of the first image forming part and a distance from the center of mass to the contact position.

3. The image forming apparatus according to claim 2, wherein:

the image forming part comprises a third image forming part comprising a third photoreceptor that is disposed on a downstream side relative to the second image forming part in the circulation direction of the transfer belt and on an upstream side relative to the nip position in the circulation direction of the transfer belt; and a product of mass of the third image forming part and a distance from the center of mass to the contact position is larger than the product of the mass of the second image forming part and the distance from the center of mass to the contact position.

4. The image forming apparatus according to claim 3, wherein:

the transfer cylinder has a recessed part formed on an outer circumferential surface thereof; and the transfer unit has an opposed roller that is disposed so as to face the transfer cylinder and is pressed against the outer circumferential surface of the transfer cylinder with the transfer belt interposed therebetween.

5. The image forming apparatus according to claim 4, wherein:

the recessed part is a recessed part in which the gripper is stored.

6. The image forming apparatus according to claim 5, wherein:

mass of a transport unit including the transfer cylinder, the sprocket, the gripper, and the chain is two times as large as mass of the transfer unit or larger.

7. The image forming apparatus according to claim 4, wherein:

mass of a transport unit including the transfer cylinder, the sprocket, the gripper, and the chain is two times as large as mass of the transfer unit or larger.

8. The image forming apparatus according to claim 3, wherein:

mass of a transport unit including the transfer cylinder, the sprocket, the gripper, and the chain is two times as large as mass of the transfer unit or larger.

9. The image forming apparatus according to claim 2, wherein:

the transfer cylinder has a recessed part formed on an outer circumferential surface thereof; and the transfer unit has an opposed roller that is disposed so as to face the transfer cylinder and is pressed against the outer circumferential surface of the transfer cylinder with the transfer belt interposed therebetween.

10. The image forming apparatus according to claim 9, wherein:

the recessed part is a recessed part in which the gripper is stored.

11. The image forming apparatus according to claim 10, wherein:

mass of a transport unit including the transfer cylinder, the sprocket, the gripper, and the chain is two times as large as mass of the transfer unit or larger.

12. The image forming apparatus according to claim 9, wherein:

mass of a transport unit including the transfer cylinder, the sprocket, the gripper, and the chain is two times as large as mass of the transfer unit or larger.

13. The image forming apparatus according to claim 2, wherein:

mass of a transport unit including the transfer cylinder, the sprocket, the gripper, and the chain is two times as large as mass of the transfer unit or larger.

14. The image forming apparatus according to claim 2, wherein:

the mass of the image forming part configured to form an image to be transferred onto the transfer belt is 100 kg or larger.

15. The image forming apparatus according to claim 1, wherein:

the transfer cylinder has a recessed part formed on an outer circumferential surface thereof; and the transfer unit has an opposed roller that is disposed so as to face the transfer cylinder and is pressed against the outer circumferential surface of the transfer cylinder with the transfer belt interposed therebetween.

16. The image forming apparatus according to claim 15, wherein:

the recessed part is a recessed part in which the gripper is stored.

17. The image forming apparatus according to claim 16, wherein:

mass of a transport unit including the transfer cylinder, the sprocket, the gripper, and the chain is two times as large as mass of the transfer unit or larger.

18. The image forming apparatus according to claim 15, wherein:

mass of a transport unit including the transfer cylinder, the sprocket, the gripper, and the chain is two times as large as mass of the transfer unit or larger.

19. The image forming apparatus according to claim 1, wherein:

mass of a transport unit including the transfer cylinder, the sprocket, the gripper, and the chain is two times as large as mass of the transfer unit or larger.

20. The image forming apparatus according to claim 1, wherein:

the mass of the image forming part configured to form an image to be transferred onto the transfer belt is 100 kg or larger.

* * * * *